United States Patent [19]

Lööv

[11] 4,445,802

[45] May 1, 1984

[54] SYSTEM OF PREFABRICATED CONCRETE ELEMENTS FOR CONSTRUCTING PATHS

[75] Inventor: Björn Lööv, Upsala, Sweden

[73] Assignee: Aktiebolaget S:t Eriks Betong, Uppsala, Sweden

[21] Appl. No.: 375,567

[22] Filed: May 6, 1982

[30] Foreign Application Priority Data

May 25, 1981 [SE] Sweden ..... 8103275

[51] Int. Cl.[3] ..... E01C 5/06

[52] U.S. Cl. ..... 404/40; 404/34; 404/39; 404/7; 404/43

[58] Field of Search ..... 404/18, 34, 32, 37, 404/39, 40, 41, 43, 7

[56] References Cited

U.S. PATENT DOCUMENTS

| | | | |
|---|---|---|---|
| 392,277 | 11/1888 | Loy | 404/34 X |
| 2,199,700 | 5/1940 | Gramelspacher | 404/32 X |
| 2,471,226 | 5/1949 | Maccario | 404/7 |
| 3,242,832 | 3/1966 | Schnaar | 404/39 |
| 4,083,190 | 4/1978 | Pey | 404/41 X |

FOREIGN PATENT DOCUMENTS

| | | | |
|---|---|---|---|
| 488321 | 11/1952 | Canada | 404/34 |
| 597301 | 8/1959 | Italy | 404/43 |
| 50810 | 8/1941 | Netherlands | 404/34 |
| 136 | of 1881 | United Kingdom | 404/41 |
| 310131 | 4/1929 | United Kingdom | 404/37 |

*Primary Examiner*—Ernest R. Purser
*Assistant Examiner*—Beverly E. Hjorth
*Attorney, Agent, or Firm*—Murray Schaffer

[57] ABSTRACT

Prefabricated concrete elements for constructing paths corresponding to a width N or a multiple thereof contain two groups. The first group comprises flat, four-sided slabs for the straight sections of the path, having a dimension corresponding to the normal width N or half said normal width. The second group of prefabricated concrete elements comprise a plurality of sets of flat, sector slabs for the curved sections of the path having different predetermined radius each set consists of sector slabs having a predetermined radius and radii having a dimension corresponding to the normal width.

10 Claims, 8 Drawing Figures

SYSTEM OF PREFABRICATED CONCRETE ELEMENTS FOR CONSTRUCTING PATHS

BACKGROUND OF THE INVENTION

The present invention relates to a system of prefabricated concrete elements for constructing paths in the form of walks and cycle paths and the like paths for light traffic, having a predetermined width corresponding to normal width (N) or a multiple thereof.

Various methods are used for constructing walks and cycle paths, for instance pavements or side-walks, the most usual being spreading asphalt on a prepared surface by machine or laying small slabs, i.e. a large number per $m^2$, on a similar surface manually. In either case a curbstone is usually constructed before laying either a continuous layer of asphalt which is cast to the street or a large number of stones in the form of cut stones or prefabricated concrete elements which are dug down slightly below street level or adhered to the street.

Both methods require a considerable amount of work, are expensive and the work must be performed in various stages during the building of the path. The curbstone constructions constitute one unit and the actual walking surface another unit of the pavement. The only development has been directed towards attempts to improve the curbstones and their laying so that they withstand the considerable strain they are subjected to from regular traffic, snow-ploughs and so on. It has been found that the concrete curbstones are adhered so efficiently that they do not come loose from the street when run into by a snow-plough, for instance, but instead a piece of the road surface itself is torn loose and must then be repaired. Even an asphalted pavement is sensitive to stresses from vehicles and can easily be damaged, settle or become lower since the actual layer of asphalt is relatively thin. As to stone pavements, their walking surface is extremely unsteady and requires repeated relaying along sections of varying length since the paving stones are relatively small and too light and also relatively thin to give the desired stability. Another not insignificant problem, particularly with asphalted pavements or cycle paths, is that the inner edge of the path, facing away from the curb, cannot be made straight and stable, but will be relatively sensitive to cracking and settling. Besides increasing maintenance and repair costs, this is also a serious risk to the safety of users and may even cause sprains due to a false step and serious injury in the event of falling off a bicycle or the like due to unevenness and potholes at the inner edge of the walk or cycle path. Neither is the uneven, pitted and non-straight edge satisfactory from the esthetic point of view.

U.S. Pat. No. 1,505,411 describes blocks to form straight and curved portions of a walk. No sets of curved blocks are disclosed wherein each set has a different radius while the radii of the block in each set is the width of the pavement. The blocks are composed of a frame with a plurality of transverse and longitudinal strips and a marginal flange for supporting the strips. The frame is filled with concrete that covers the strips and a reinforcing mesh material.

GB Pat. No. 591,077 refers to a paving that comprises the combination of slabs, visible or surface forming bearers between the slabs, and curbs. A curve in the pavement is composed of a plurality of sector slabs which together form the whole width of the paving between the curbs.

GB Pat. No. 1,448,564 describes a sector-forming set of a plurality of small interlocking blocks for use with a plurality of other interlocking blocks, the blocks having engaging protuberances and recesses to obtain the interlocking effect. To make the whole width of the pavement it will be necessary to use a plurality of small blocks.

It can be seen from the above that laying pavements involves considerable and varying problems and that there has been a great need for improvement in the construction of pavements and other walks and cycle paths, intended for pedestrians and light, generally two-wheeled vehicles.

One object of the present invention is therefore to achieve an improved system for construction of walks and cycle paths which entirely, or at least substantially eliminates most of the problems mentioned above.

SUMMARY OF THE INVENTION

According to the present invention there is provided a first group of prefabricated concrete elements comprising flat, four-sided, preferably rectangular slabs for the straight sections of the path, having a dimension ($d_1$ or $d_{\frac{1}{2}}$) that corresponds to said normal width or half said normal width, and a second group of prefabricated concrete elements comprising a plurality of sets of flat, radius slabs for the curved sections of the path, having different predetermined radius wherein each set consists of slabs having a predetermined radius and a dimension ($d_1$) corresponding to the normal width.

The invention eliminates a building unit which was previously required, i.e. the curbstone construction, since the system comprises concrete elements so designed that they have curb-forming function at the same time as forming the actual walk or cycle path. The new system is thus totally free from separate curbstones. The unique new system according to the present invention enables walks and cycle paths to be constructed in a continuous manner on a previously prepared surface. Any predetermined stretch or design for a walk or cycle path can be formed by means of a few shapes for the concrete elements.

BRIEF DESCRIPTION OF THE DRAWINGS

The invention will be described in the following with reference to preferred embodiments of concrete elements according to the new system, with reference to the accompanying drawings in which.

DESCRIPTION OF THE INVENTION

Figure 1:
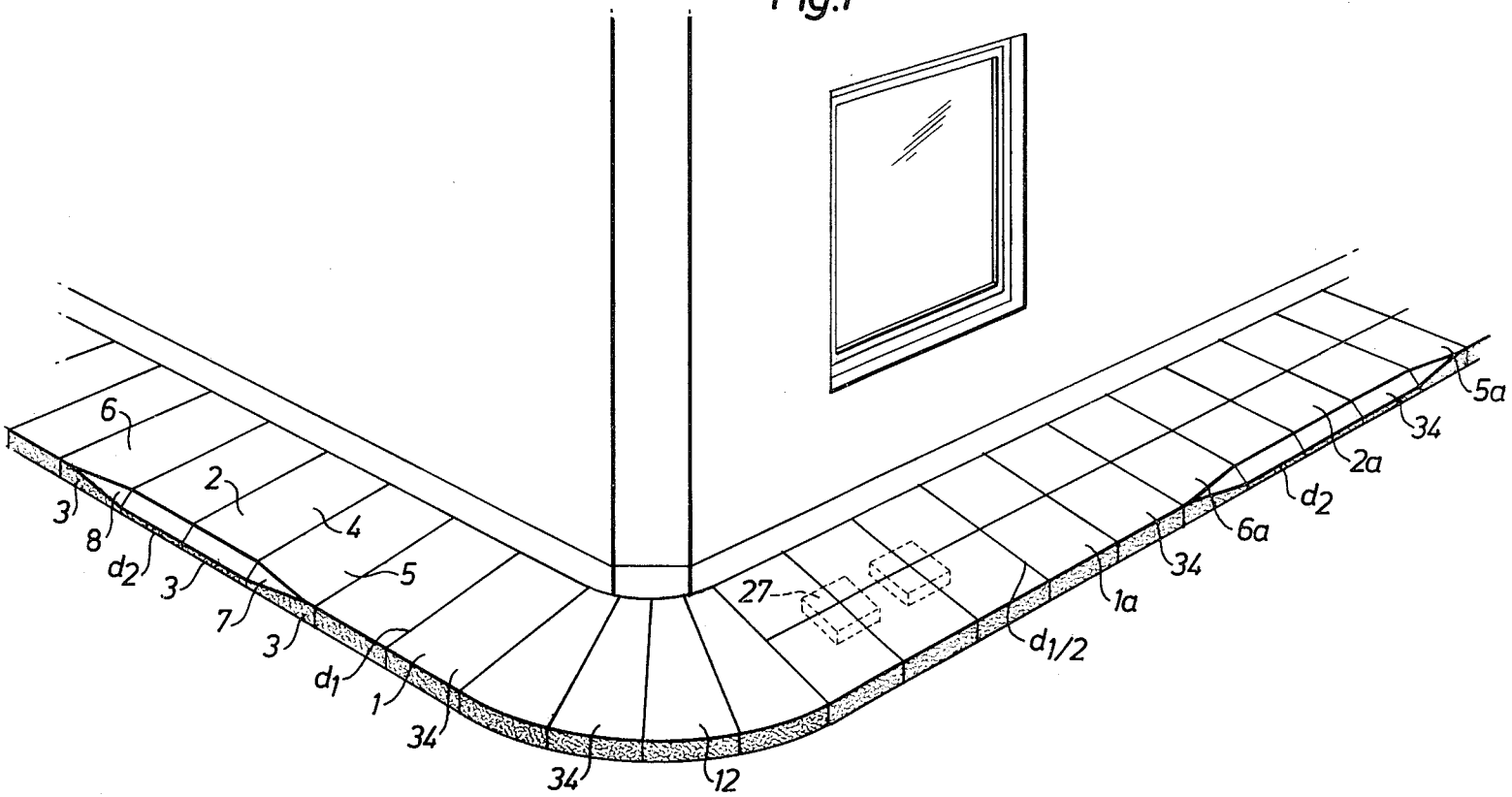
FIG. 1 shows a stretch of pavement at a street corner, the pavement having been constructed in accordance with the new system.

FIG. 1 shows a stretch of path in the form of a pavement constructed according to the present invention. This system comprises a few, substantially only two main groups of prefabricated concrete elements with common characteristics in the main groups.

Figure 2:
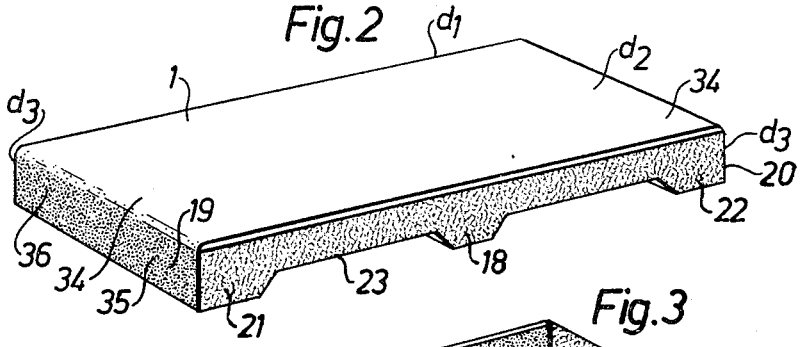
FIGS. 2 and 3 show a rectangular slab seen in perspective from above and from below, respectively.
Figure 3:
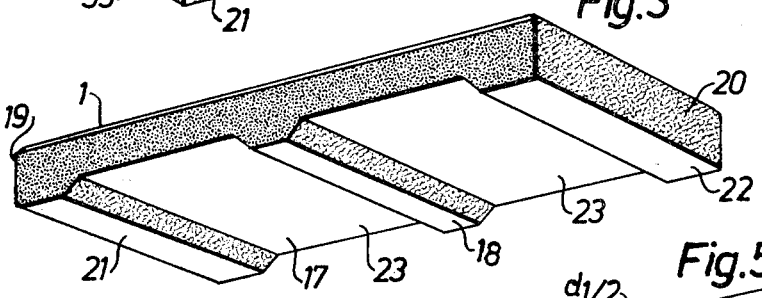

The first group of prefabricated concrete elements comprises flat, rectangular slabs for straight sections of the path. These slabs preferably have a dimension $d_1$, normally the longitudinal dimension, corresponding to the width of a pavement of a normal width N. In Sweden this is currently 1500 mm, i.e. a single slab has the finished normal width N of the pavement. The second dimension $d_2$, i.e. the width dimension, is chosen from practical reasons such as ease of manufacture and handling. A suitable width has currently been found to be 700 mm. This first group is in turn divided into a first set of flat, rectangular slabs 1 with whole, vertical sides as shown in FIGS. 1–3; a second set of flat, rectangular slabs 2, each having a vertical side 3 in the dimension $d_2$ which is perpendicular to the dimension $d_1$, bevelled straight towards the upper 4 of the slab; a third set of flat, rectangular slabs 5, each having a vertical side 3 in the dimension $d_2$ bevelled obliquely towards the upper side 4 from the vicinity of the righthand upper corner down towards the opposite lefthand vertical surface in the dimension $d_1$; and a fourth set of flat, rectangular slabs 6, each having a vertical side 3 in the dimension $d_2$ bevelled obliquely towards the upper side 4 of the slab from the vicinity of the lefthand corner down towards the opposite righthand vertical side in the dimension $d_1$. The slabs 5, 6 in the third and fourth sets are thus symmetrical with wedge-shaped or oblique bevellings 7, 8 running in opposite directions. The slabs with straight and oblique bevellings are used to provide crossings as illustrated in the lefthand part of FIG. 1. Naturally the expression "whole vertical sides" is not limiting, and small esthetic bevellings or radii may be provided towards the upper side for practical and esthetic reasons, as shown in the drawings.

Alternatively, the slabs in the first group may be given a dimension $d_{\frac{1}{2}}$, corresponding to half the width of a pavement of normal width N. This dimension $d_{\frac{1}{2}}$ is thus 750 mm, whereas the second dimension $d_2$ is 700 mm as for the slabs described earlier. These half-slabs are also divided into four different sets, i.e. slabs 1*a* with whole vertical sides and slabs 2*a*, 5*a* and 6*a* with vertical sides in the dimension $d_2$ which are either straight or obliquely bevelled in the same way as the slabs described earlier, as can be seen in the stretch of pavement on the right in FIG. 1.

The second group of prefabricated concrete elements comprises a predetermined number of sets of flat, circular sector slabs for the curve or arcuate section of the pavement each set having different predetermined radii. Each set consists of radius slabs which individually or together have a predetermined radius or arc on the path and radii which themselves have a dimension $d_1$ corresponding to the width of a normal pavement, i.e. 1500 mm.

Figure 8:
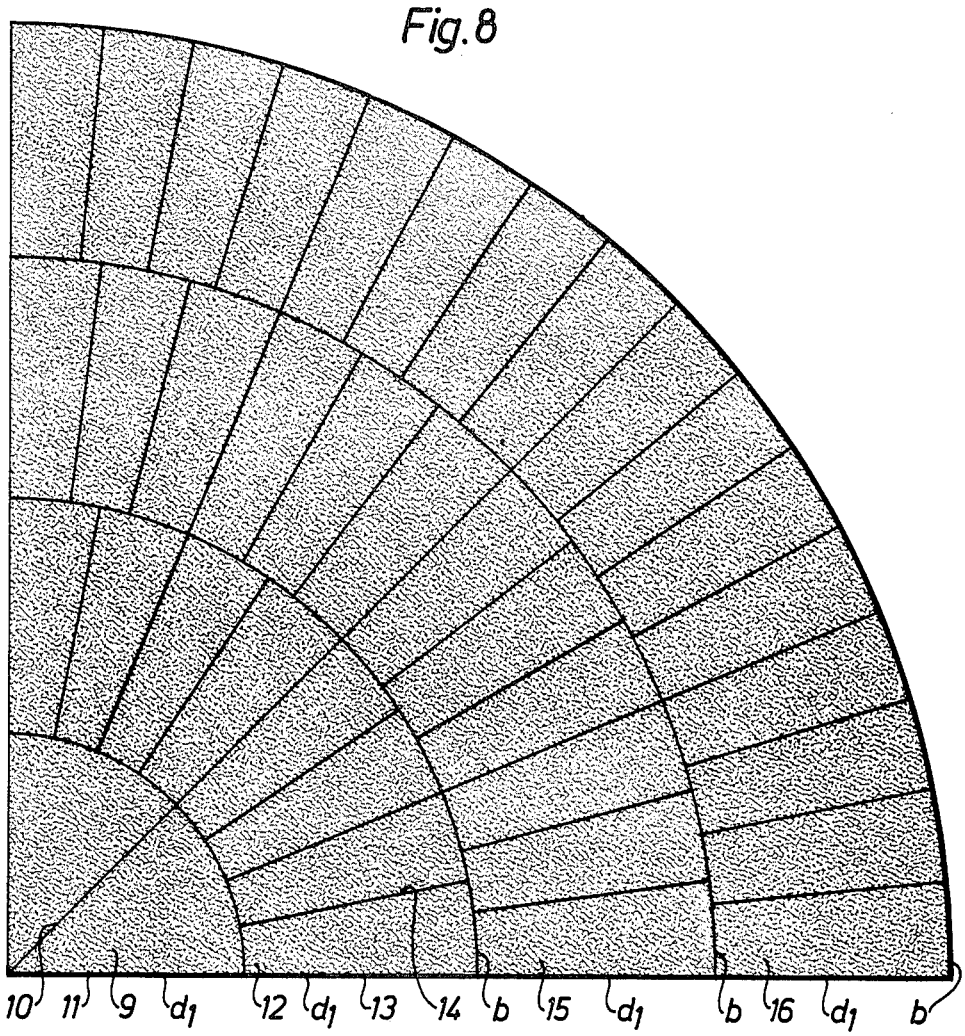
FIG. 8 illustrates the distribution of various sets of radius slabs having different radii.

The first set of radius slabs 9 has the smallest radius. The system should include such first radius slabs which do not give any increase in length at the inner edge of the pavement, for a 90° turn around a street corner, for instance. A geometric illustration of a preferred division of the sets of radius slabs is shown in FIG. 8. The first set of radius slabs 9 provides a curved section of the path which does not increase in length at the inner edge of the pavement since the vertical sides 10, 11, with the dimension $d_1$ start from a center of origin. It is preferred to make these first radius slabs 9 with their vertical sides at an angle of 45° to each other. Such a 45° sector slab can be further divided into uniform pieces, 22.5° sector pieces, for instance, although these may be damaged if handled carelessly, due to being too pointed. If desired, the first radius slab may be in the form of a 90° sector slab.

The second set of radius slabs 12 have a radius twice that of the first set of slabs 9, and each such slab 12 is preferably shaped so that the vertical sides 13, 14 form an angle of 11.25° with each other, requiring eight such slabs to a 90° curve.

The third set consists of radius slabs 15 have a radius that is twice as great as the radius of the first set of slabs 9, and each such slab 15 is suitably so shaped that the vertical sides form an angle of 7.5° to each other, requiring twelve such slabs to a 90° curve.

The fourth set of radius slabs 16 has a radius four times that of the first set of slabs 9, and each such slab 16 is shaped so that the vertical sides form an angle of 5.625° to each other, making sixteen such slabs to a 90° curve. As shown, the radius slabs in each set are uniform and equal in size, which is preferred for several reasons.

Further sets of radius slabs may be included in the system if desired, each having a radius which is similarly whole multiples of the first radius. However, the sets shown here are sufficient for normally curved sections of path.

Common features in the various sets of radius slabs are that they have the same dimension $d_1$ and, for the last three sets, the same length along the outer arc b, whereas each radius slab of the first set has a length 2*b* along its arc in accordance with the embodiment shown.

With the dimension $d_1$ corresponding to the normal equal to 1.5 meter of a path, therefore, the various sets of radius slabs 9, 12, 15, 16 will have radii of 1.5 meter, 3.0 meter, 4.5 meter and 5.0 meter, etc., respectively, i.e. a whole multiple of the radius of the first radius slab or in other words of the dimension $d_1$.

If for some reason radius slabs in the first set are desired with a radius greater than said normal width or dimension $d_1$, 2.5 meter, for instance, each subsequent set of radius slabs should have a radius $r_n$ which is determined by the formula $r_n = n \times d_1 + r_o$, where $r_o$ is the radius of the inner, unused sector and n is the number of the actual set of radius slabs. In the example given $r_1 = 2.5$ and $d_1 = 1.5$ meter, i.e. $r_o = 1$ meter, the radius for the fourth set of radius slabs will therefore be $r_4 = 4 \times 1.5 + 1.0 = 7.0$ meter.

Figure 5:
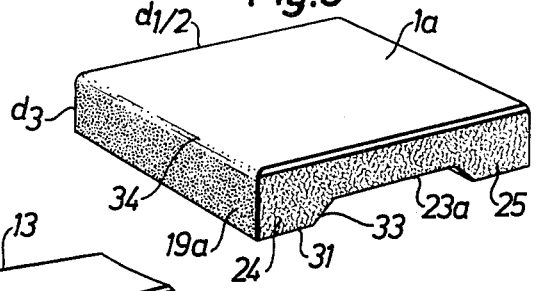
FIG. 5 shows a rectangular half-slab seen in perspective from above.
Figure 4:
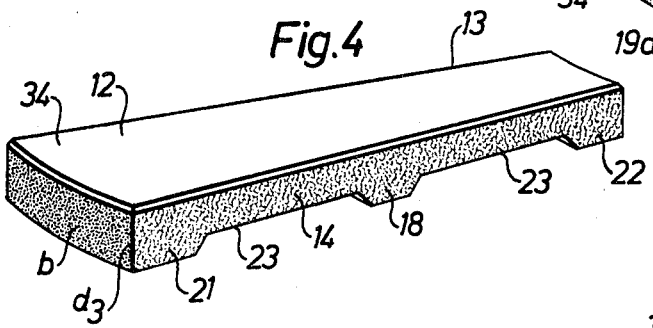
FIG. 4 shows a radius slab seen in perspective from above.
Figure 6:
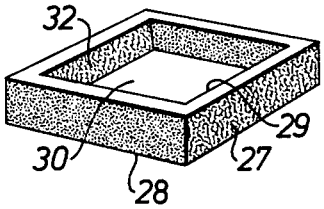
FIG. 6 shows an interlocking and supporting element which may be used with rectangular half-slabs in accordance with FIG. 5.
Figure 7:
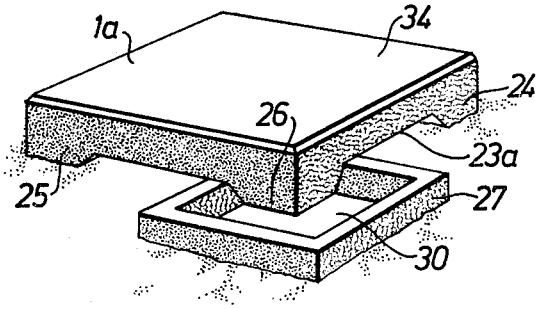
FIG. 7 illustrates the use of an interlocking and supporting element in accordance with FIG. 6.

Like the radius slabs, the rectangular slabs, both of which have a dimension $d_1$ corresponding to the normal width of the walk, are provided on the lower side 17 with continuous, transverse support portions, that is to say a support portion 18 located centrally and a support portion 21, 22 at each of the opposing end sides 19, 20, thus leaving recesses 23 being the support portions. The support portions thus extend in the direction of the path. The half-slabs are also provided with support portions on their lower side and these may extend continuously along each of the opposing end sides. FIGS. 5 and 7 show a different half-slab with support portions of preferred design. A continous support portion 24 is thus provided at the end side 19*a*, which is to face away from an adjacent inner slab, and two support portions in the form of support feet 25, 26 at the opposite corners, giving recesses 23*a* between the two support feet and between the continuous support portion and each support foot. Such half-slabs provided with support feet are preferably used together with specially designed prefabricated concrete interlocking and supporting slabs 27. The interlocking and supporting slab in quadratic and has a flat lower side 28 and a recess 29 with a bottom surface 30 approximately four times as great as the surface 31 of the lower side of a foot, and with slanting wall surfaces 32 corresponding to the slanting surfaces 33 of the support feet, in order to provide satisfactory anchoring effect. Such an interlocking and supporting slab is placed slightly immersed in the foundation so that its inner bottom surface 30 is on a level with the surface of the foundation. The interlocking and supporting slab is placed at the intersection point for four half-slabs, thus securing these to each other by one foot in the interlocking and supporting slab (see FIG. 7).

An important feature of the slabs in the system according to the present invention is that in themselves they are capable of forming a curb and that no special curbstones are therefore necessary together with the slabs. To this end the slabs have a third dimension $d_3$, i.e. the thickness dimension, such that portions 34 of the end surfaces 19, 20 of the slabs provide a curbstone effect. These portions 34 thus include the support portions 21, 22, 24 on the lower sides of the slabs. The thickness $d_3$ is selected so that a lower part 35 of the end surface 19 will lie below the actual street level and an upper, curb-forming part 36 of the end surface will be above this street level. This upper part shall be sufficient in vertical direction to enable the adjacent road to be re-asphalted, for instance, and still retain the curbstone function and effect of the slabs. The slabs have a thickness $d_3$, dependent of the type of path to be constructed, its located and traffic load. Suitable thicknesses are 100, 120, 140 and 160 mm.

The group of radius slabs may of course also include different sets of radius slabs with straight and oblique bevelling to provide crossings in the same way as the slabs of the first group.

The system according to the invention may possibly include a third group of prefabricated concrete elements having different shapes and sizes for the construction of less usual side or partial sections of the path. However, in order to reduce the range and thus the costs, such unusual sections should be avoided in the planning of paths.

Slabs in accordance with the new system, and particularly slabs in accordance with its two main groups may include those provided with vertical through-holes for placing and anchoring posts for traffic signs, ticket machines or railings, for instance.

From the manufacturing and cost point of view, as well as for other important reasons, it is preferable to make the slabs within each set the same shape and size, i.e. congruent with each other. However, it will be understood that the invention can be varied in many ways in this respect, within the scope of the following claims. Slabs which are too pointed (below about 45°) should, however, be avoided since the points can easily be damaged. Thus, the slabs of the first group can be made with end sides which are to form the inner and outer edges of the path in the same way as slabs described earlier, but with the two other sides forming an angle with each other, each least one of these sides being oblique in relation to the centre line of the path, i.e. forming an angle with the dimension $d_1$ of the slab. In the same way, the radius slabs can be varied in shape so that one or both the sides extending between the two end edges are greater than the dimension $d_1$.

The shown slabs, which are preferred for a number of reasons, are symmetrical with respect to the longitudinal centre lines (i.e. corresponding to the dimension $d_1$) and also with respect to their transverse centre line in the case of the slabs according to the first group.

The mentioned problems arising with the unsatisfying inner edge of prior known paths are also overcome with the slabs according to the present invention, which form a straight and even inner edge, entirely free from potholes, and parallel or concentric to the outer edge next to the roadway. Furthermore, the slabs are sufficiently heavy, even those of half normal size, to lie firmly in position under normal strain. Another advantage is that either end of the stones cn be used to provide the curb effect.

If desired the slabs may be provided with engaging non-visible locking means which prevent the slabs to move in the direction from the centre line of the path. Thus, one of the longitudinal sides of each slab can be provided with two recesses, for instance, which extend from under beneath the stone and terminate at a sufficient distance from the upper surface of the stone, the opposite longitudinal side of a second slab being provided with corresponding projections to be received by said recesses. Thus, the upper edge of each projection is spaced from the upper surface of the slab, while the lower edge may be in level with the lower surface of the slab. The recesses and projections may be in the form of an upside-down U, for instance. The locking means permit the slabs to be lifted up and removed or replaced, if desired.

Thus, the invention provides a new system of precast concrete elements divided into two groups of slabs each group containing a few set of different slabs all of which preferably having a dimension which corresponds to the normal width of the path. All edges of the slabs which are transverse to the path centre line are straight. The slabs have an inherent curbstone-forming effect so that separate curbstones are superfluous in the system. The slabs are free of frames and free of visible or surface forming bearers between the slabs and also free of loose locking means for securing slabs together.

What I claim is:

1. A combination of prefabricated concrete elements for constructing paths in the form of walks and cycle paths and the like for light traffic and having a predetermined width corresponding to normal minimal width N, the combination of prefabricated concrete elements adapted to rest on the ground and extend at least on part above the ground, comprising a first group of prefabricated concrete elements comprising flat, four-sided slabs for the straight sections of the path, and a second group of prefabricated concrete elements consisting of flat radius slabs for forming the curved sections of the path, said first group of elements comprising four sets of slabs each slab having at least one curb forming end surface, the end surface of the first set being vertical, the end surface of the second set being straight bevelled the end surface of the third set of slabs being obliquely bevelled towards a first opposite corner and the end surface of the fourth set being obliquely bevelled towards a second opposite corner; said second group comprising a first set of radius slabs and a plurality of sets of flat radius slabs each having a large arc and a small arc concentric with each other, the slabs in the first set of said second group having a predetermined radius which is equal to said normal width N, each of the remaining sets having slabs respectively which increase serially in radius equal to the radius of the immediately preceding set plus the normal minimal width N, the slabs of each set of said second group having edge portions at at least one of said arcs designed to form the outer contour of the path, providing a curb-forming effect.

2. The combination according to claim 1 wherein the slabs within each of the respective sets of said second group are identical, and the length of the larger arcs for all of the slabs in all of the sets except for the set with the smallest radius is the same.

3. The combination according to claim 2, wherein the slabs within each set subtend an angle which is a whole fraction of a predetermined larger angle.

4. The combination according to claim 3 wherein the predetermined large angle is a multiple of 45°.

5. The combination according to claim 1 wherein the slabs in said first group are parallellepiped and have support members depending therefrom, two of said support members being included in the curb forming end surfaces, each said slab being symmetrical about each of its two vertical central planes.

6. The combination according to claim 1 wherein each slab of the second group is provided with support members depending therefrom, two of which are included in its curb forming surfaces, each said slab being symmetrical with respect to its vertical longitudinal central plane.

7. The combination according to claim 1 wherein each slab of said first group has a dimension corresponding to the normal minimum width.

8. The combination according to claim 1 wherein each slab of said first group has a dimension corresponding to one half the normal minimum width.

9. The combination according to claim 8 wherein the slabs in those sets having a dimension corresponding to half the normal minimal width have support feet, each of the support feet having a predetermined cross-sectional area and cooperating interlocking supporting members having a depression for receiving said feet four times as large as the area of said predetermined support feet.

10. The combination according to claim 1 wherein the first group has a portion of its slabs having a dimension corresponding to the normal minimum width and a portion of its slabs having a dimension corresponding to one half of the normal minimal width.

* * * * *